US009991660B2

(12) United States Patent
Kehoe

(10) Patent No.: US 9,991,660 B2
(45) Date of Patent: Jun. 5, 2018

(54) DIE HOLDER

(71) Applicant: MILWAUKEE ELECTRIC TOOL CORPORATION, Brookfield, WI (US)

(72) Inventor: Sean T. Kehoe, Waukesha, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days. days.

(21) Appl. No.: 15/585,300

(22) Filed: May 3, 2017

(65) Prior Publication Data

US 2017/0324206 A1 Nov. 9, 2017

Related U.S. Application Data

(60) Provisional application No. 62/331,771, filed on May 4, 2016.

(51) Int. Cl.
*H01R 43/042* (2006.01)
*B65D 85/24* (2006.01)

(52) U.S. Cl.
CPC ..... *H01R 43/042* (2013.01); *B65D 85/24* (2013.01)

(58) Field of Classification Search
CPC . H01R 43/042; B65D 85/24; B23Q 3/155526
USPC ..... 72/482.91
See application file for complete search history.

(56) References Cited

U.S. PATENT DOCUMENTS 2,367,253 A 1/1945 Williams
2,905,339 A 9/1959 Orchard
3,019,520 A 2/1962 Woolley
3,841,472 A 10/1974 Fuller
3,885,669 A 5/1975 Potucek
4,606,455 A 8/1986 Grikis
4,684,113 A 8/1987 Douglas
4,955,476 A 9/1990 Nakata
5,096,061 A 3/1992 Wakai
5,385,183 A 1/1995 Ferranti
5,452,796 A 9/1995 Ohuchi
5,499,724 A 3/1996 Hickman
5,762,190 A 6/1998 Leistner
5,823,338 A 10/1998 Osterle
5,927,517 A 7/1999 Lipman
6,227,030 B1 5/2001 Lefavour
6,361,035 B1 3/2002 Collins
6,640,968 B2 11/2003 Selle
6,688,208 B2 2/2004 Campbell
(Continued)

*Primary Examiner* — David B Jones

(74) *Attorney, Agent, or Firm* — Michael Best & Friedrich LLP

(57) ABSTRACT

A die holder for organizing and storing at least one die for use with a crimping tool comprises a body including a first surface and a second surface parallel to and spaced from the first surface, and a first bore extending from the first surface toward the second surface. The first bore terminates at a location that is spaced from the second surface. The die holder further comprises a die holding pin at least partially received within the first bore and having a first portion with a first outer dimension and a second portion with a second outer dimension greater than the first outer dimension. The die holding pin is movable between a die retaining position and a die releasing position. The die holder also comprises a spring configured to bias the die holding pin from the die releasing position toward the die retaining position.

22 Claims, 7 Drawing Sheets

(56) References Cited

U.S. PATENT DOCUMENTS

| | | | | |
|---|---|---|---|---|
| 7,458,462 | B2 * | 12/2008 | Carr | B23Q 3/15526 206/343 |
| 2004/0195748 | A1 | 10/2004 | Carr | |

* cited by examiner

DIE HOLDER

CROSS-REFERENCE TO RELATED APPLICATIONS

This application claims priority to U.S. Provisional Patent Application No. 62/331,771 filed on May 4, 2016, the entire content of which is incorporated herein by reference.

FIELD OF THE INVENTION

The present invention relates to die holders or trees, and more particularly to quick connect mechanisms for die holders.

BACKGROUND OF THE INVENTION

Crimping dies are typically used in conjunction with a hand held crimping tool for crimping electrical conductors. For conductors having different diameters, pairs of crimping dies corresponding to those diameters may be interchangeably used with the hand held crimping tool. Accordingly, one will often have a number of differently sized pairs of crimping dies for use with the hand held crimping tool. Because the dies are used in pairs, it is desirable to keep them organized together and by crimping diameter.

SUMMARY OF THE INVENTION

The present invention provides, in one aspect, a die holder for organizing and storing at least one die for use with a crimping tool. The die holder comprises a body including a first surface and a second surface parallel to and spaced from the first surface, and a first bore extending from the first surface toward the second surface. The first bore terminates at a location that is spaced from the second surface. The die holder further comprises a die holding pin at least partially received within the first bore, the die holding pin having a first portion with a first outer dimension and a second portion with a second outer dimension greater than the first outer dimension. The die holding pin is movable between a die retaining position and a die releasing position. The die holder further comprises a spring configured to bias the die holding pin from the die releasing position toward the die retaining position.

The present invention provides, in another aspect, a die holder assembly comprising a die holder including a body having a first surface and a second surface parallel to and spaced from the first surface, and a first bore extending from the first surface toward the second surface. The first bore terminates at a location spaced from the second surface. The die holder body also includes a die holding pin at least partially received within the first bore, the die holding pin having a first portion with a first outer dimension and a second portion with a second outer dimension greater than the first outer dimension, the die holding pin movable between a die retaining position and a die releasing position. The die holder also includes a spring configured to bias the die holding pin from the die releasing position toward the die retaining position. The die holder assembly further comprises at least one die for use with a crimping tool. The die has a mounting portion defining an opening in which the second portion of the die holding pin is received when the die holding pin is in the die retaining position. The mounting portion further defines a gap adjacent the opening through which the first portion of the die holding pin is movable when the die holding pin is in the die releasing position and the die holder is moved relative to the die in a direction parallel to the first and second surfaces.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
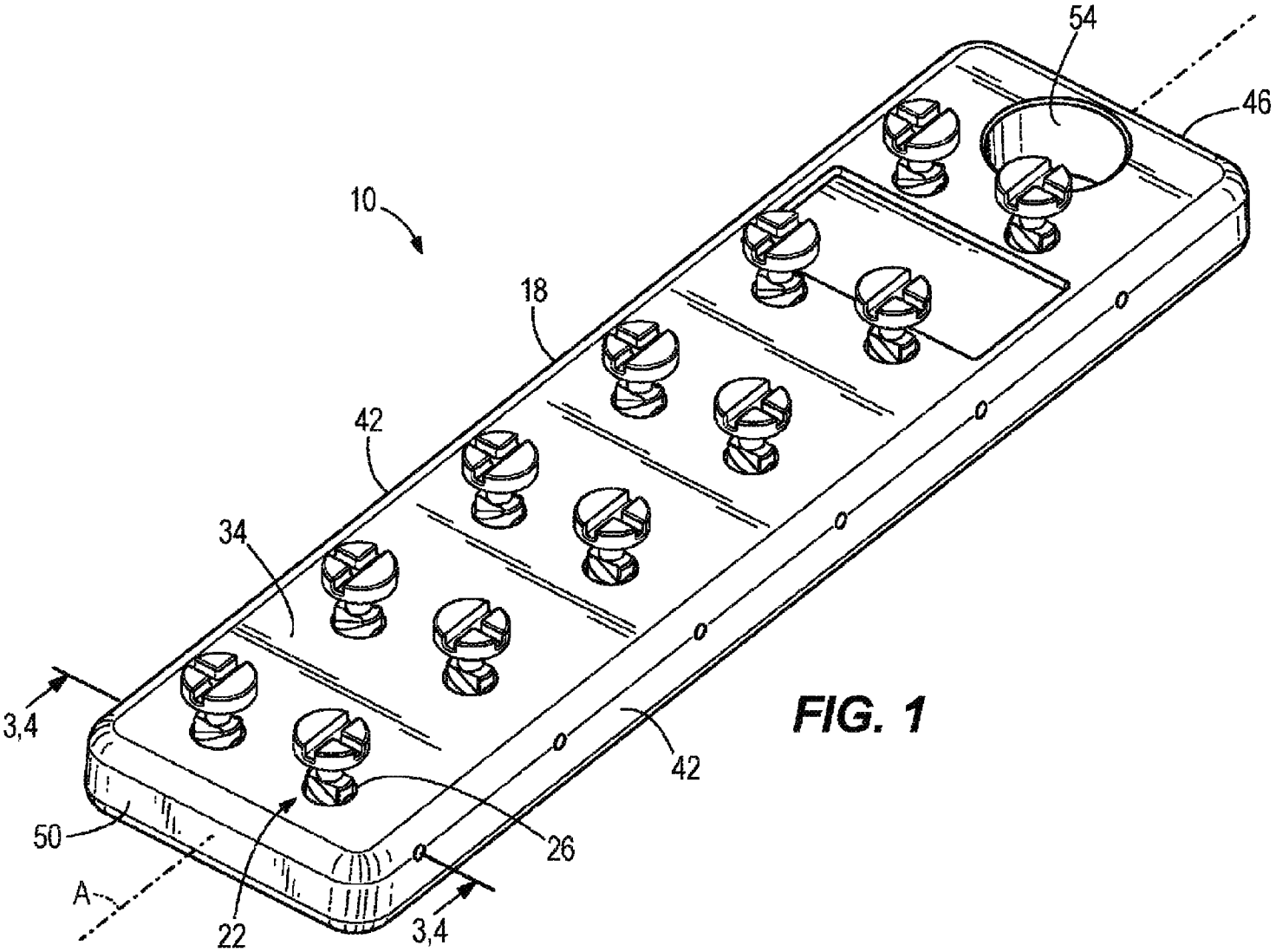
FIG. 1 is a top perspective view of a die holder in accordance with an embodiment of the invention.

FIG. 1 illustrates a die tree or die holder 10 for storing and organizing crimping dies 14 of various sizes (FIGS. 6-9). The die holder 10 includes a holder body 18 defining a longitudinal axis A and multiple die holding pins 22 received in corresponding die holding pin bores 26 defined in the holder body 18. The die holding pins 22 are arranged in two corresponding rows of six die holding pins 22 on either side of the longitudinal axis A. In alternate embodiments there may be any number of die holding pins 22 arranged in any of a number of different manners on the body 18.

Figure 2:
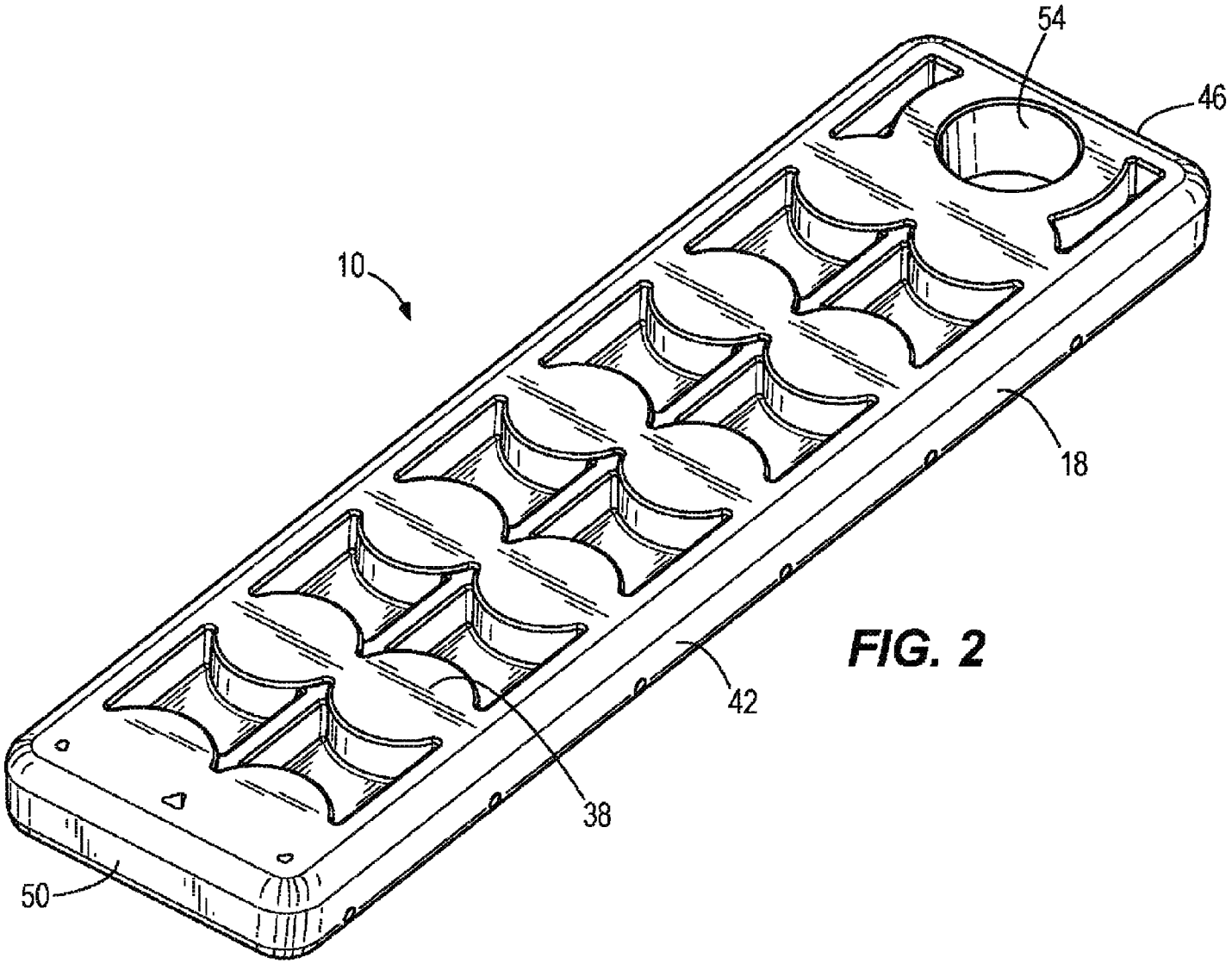
FIG. 2 is a bottom perspective view of the die holder of FIG. 1.

With reference to FIG. 1, the holder body 18 has a top side 34, a bottom side 38 (FIG. 2), and opposite longitudinal sides 42 extending parallel to the longitudinal axis A between first and second ends 46, 50. The holder body 18 also defines an opening 54 adjacent the first end 46. The opening 54 may be used to hang the die holder 10 on a hook for storage. Alternatively, the opening 54 may receive a carabineer or other clip for a user to carry the die holder 10.

Figure 3:
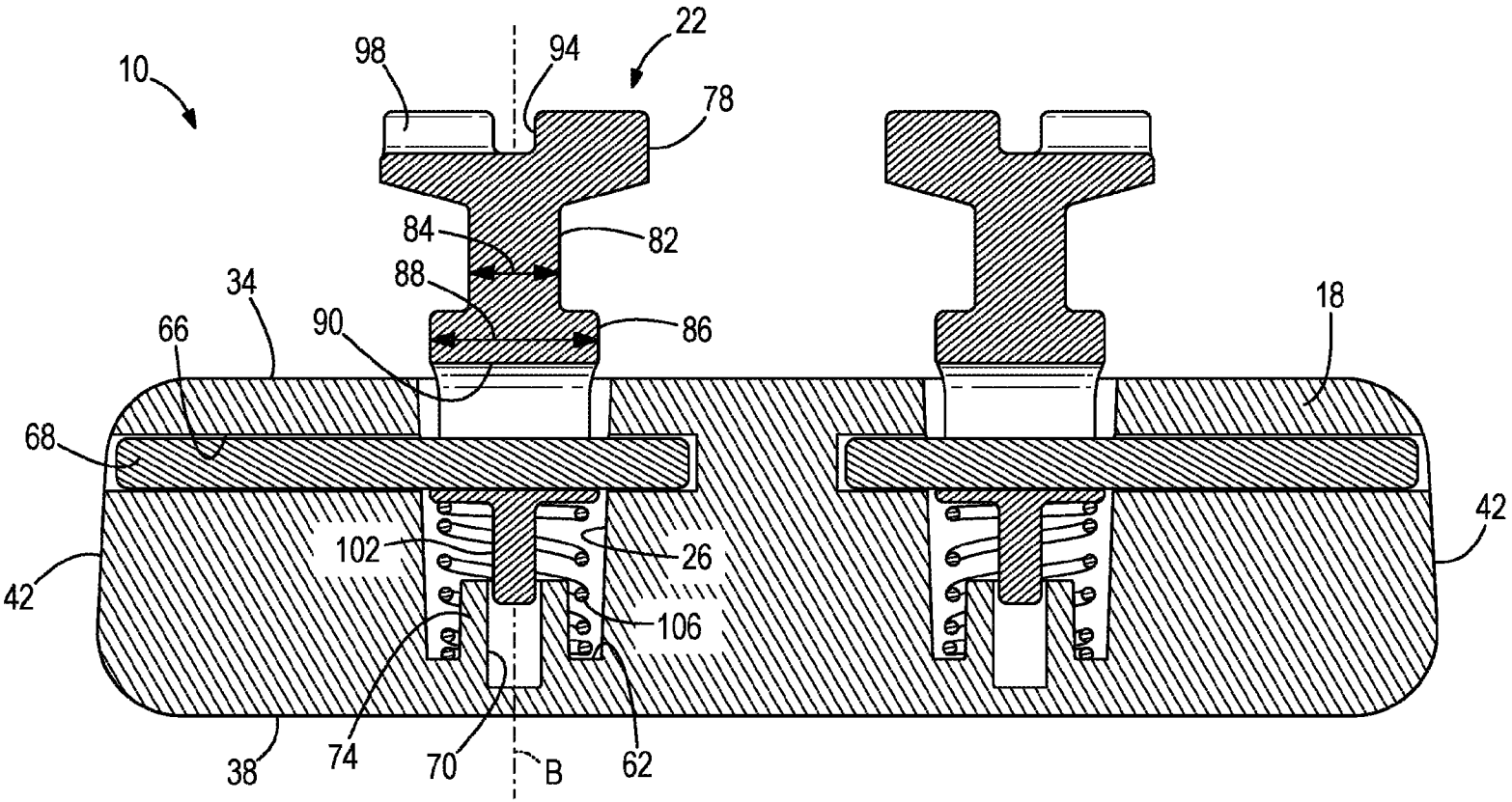
FIG. 3 is a cross-sectional view of the die holder of FIG. 1 through line 3-3 in FIG. 1, shown with die holding pins each in a first, biased position.
Figure 4:
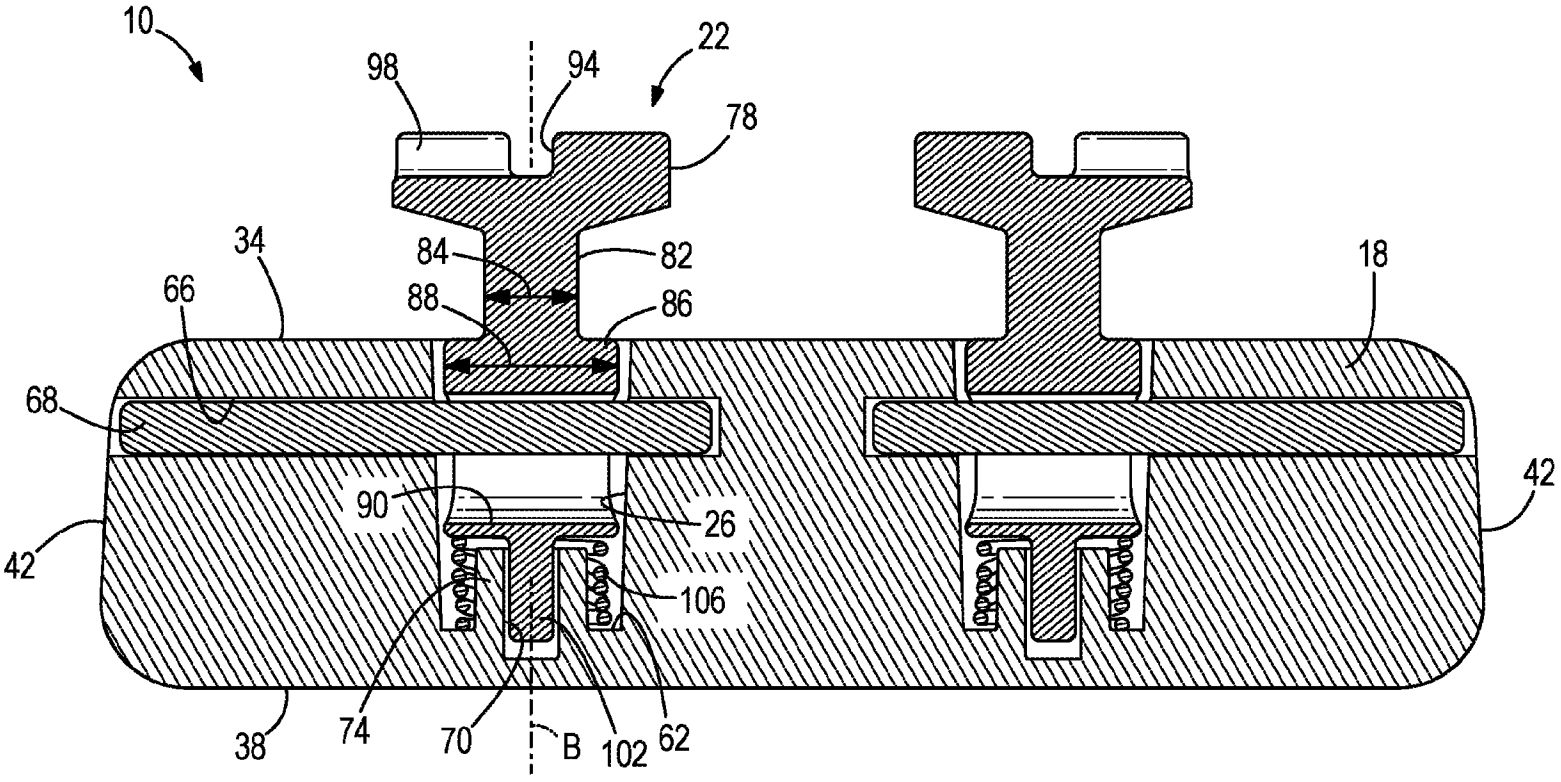
FIG. 4 is a cross-sectional view of the die holder of FIG. 1 through line 4-4 in FIG. 1, shown with the die holding pins each in a second, depressed position.

With reference to FIGS. 3 and 4, each of the die holding pin bores 26 extends from the top side 34 of the holder body 18 to a spring seating surface 62. The spring seating surface 62 is spaced from the bottom side 38 such that the die holding pin bore 26 does not extend through the bottom side 38. A retaining pin bore 66 extends transverse to and through each of the die holding pin bores 26. Each of the retaining pin bores 66 extends from the longitudinal side 42 nearest the corresponding die holding pin bore 26. Each of the retaining pin bores 66 receives a corresponding retaining pin 68. A vertical alignment bore 70 is defined in a boss 74 extending from the spring seating surface 62 within each of the die holding pin bores 26. The vertical alignment bore 70 is concentric with the die holding pin bore 26.

With continued reference to FIGS. 3 and 4, each of the die holding pins 22 includes a head 78, a first, small diameter portion 82, and a second, large diameter portion 86. The small diameter portion 82 extends between the head 78 and the large diameter portion 86 along a longitudinal axis B of the die holding pin 22. The small diameter portion 82 has a first outer diameter or dimension 84, and the large diameter portion 86 has a second outer diameter or dimension 88 greater than the first outer diameter. Accordingly, the first outer dimension 84 is less than the second outer dimension 88. An elongated slot 90 (FIG. 5) extends through the large diameter portion 86 transverse to the longitudinal axis B of the die holding pin 22. The large diameter portion 86 is axially received within the die holding pin bore 26 such that the elongated slot 90 is aligned with the retaining pin bore 66 (FIGS. 3 and 4). The elongated slot 90 receives the retaining pin, which is also received within the retaining pin bore 66 in the body 18, to retain the die holding pin 22 within the die holding pin bore 26. The elongated slot 90 is elongated along the length of the die holding pin 22 to permit axial movement of the die holding pin 22 within the die holding pin bore 26. In the illustrated embodiment, the small diameter portion 82 and the large diameter portion 86 have a circular cross-sectional shape. In some embodiments, at least one of the small diameter portion 82 or the large diameter portion 86 may have a non-circular cross-sectional shape (e.g., a rectangular cross-section). In such embodiments, the first and second outer dimensions 84, 88 may be equal to the major dimension of the small and large diameter portions 82, 86.

Figure 5:
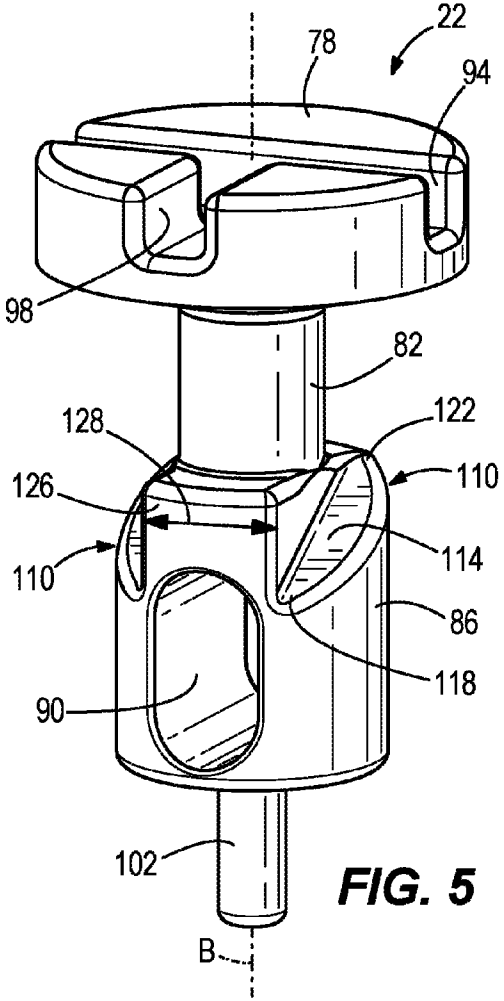
FIG. 5 is a front perspective view of a die holding pin of the die holder of FIG. 1.

With reference to FIG. 5, the head 78 of each of the die holding pins 22 defines a first groove 94 and a second groove 98. The first groove 94 extends from an outer circumference of the head 78 through a center of the head 78 to the outer circumference. The second groove 98 extends from the center of the head 78 to the outer circumference of the head 78 perpendicular to the first groove 94.

Each of the die holding pins 22 further includes a vertical alignment pin 102 that extends from the large diameter portion 86 opposite the small diameter portion 82 along the longitudinal axis B. The vertical alignment pin 102 is received by the vertical alignment bore 70 to align and center the die holding pin 22 within the die holding pin bore 26.

A compression spring 106 is positioned within each of the die holding pin bores 26 between the large diameter portion 86 and the spring seating surface 62. The compression spring 106 biases the die holding pin 22 into a first, biased, or die retaining position (FIG. 3). The retaining pin extends through the elongated slot 90 to prevent the die holding pin 22 from being ejected from the die holding pin bore 26. The die holding pin 22 may be depressed against the bias of the compression spring 106 into a second, depressed, or die releasing position (FIG. 4).

With reference to FIG. 5, the large diameter portion 86 of each of the die holding pins 22 includes a notch 110 on each side of the longitudinal axis B that defines an inclined surface 114 on opposite sides of the large diameter portion 86 that faces in the direction of the longitudinal side 42 of the body 18 nearest the respective die holding pins 22. And, each of the inclined surfaces 114 includes a lower end 118 and an upper end 122. The notches 110 are cut from the large diameter portion 86 to define a narrow portion 126 having a width 128 that is nominally equal to the first outer dimension 84 of the small diameter portion 82.

The body 18 and die holding pins 22 may be made from any suitable rigid material, such a rigid thermoplastic or metallic material. The die holder 10 may be any suitable shape or size. For example, the die holder 10 may be a size and shape suitable for fitting within a carrying case for ease of transportation.

Figure 6:
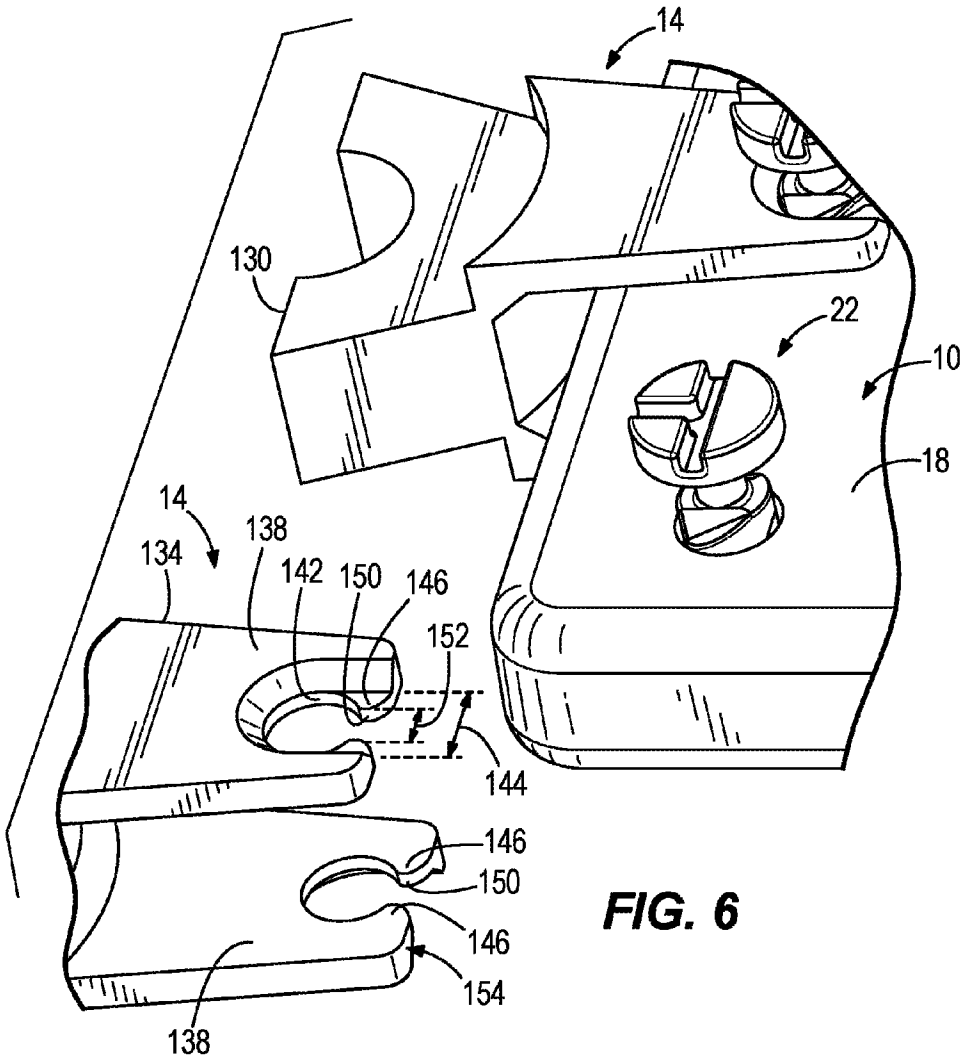
FIG. 6 is a perspective view of the die holder of FIG. 1 and a crimping die.
Figure 7:
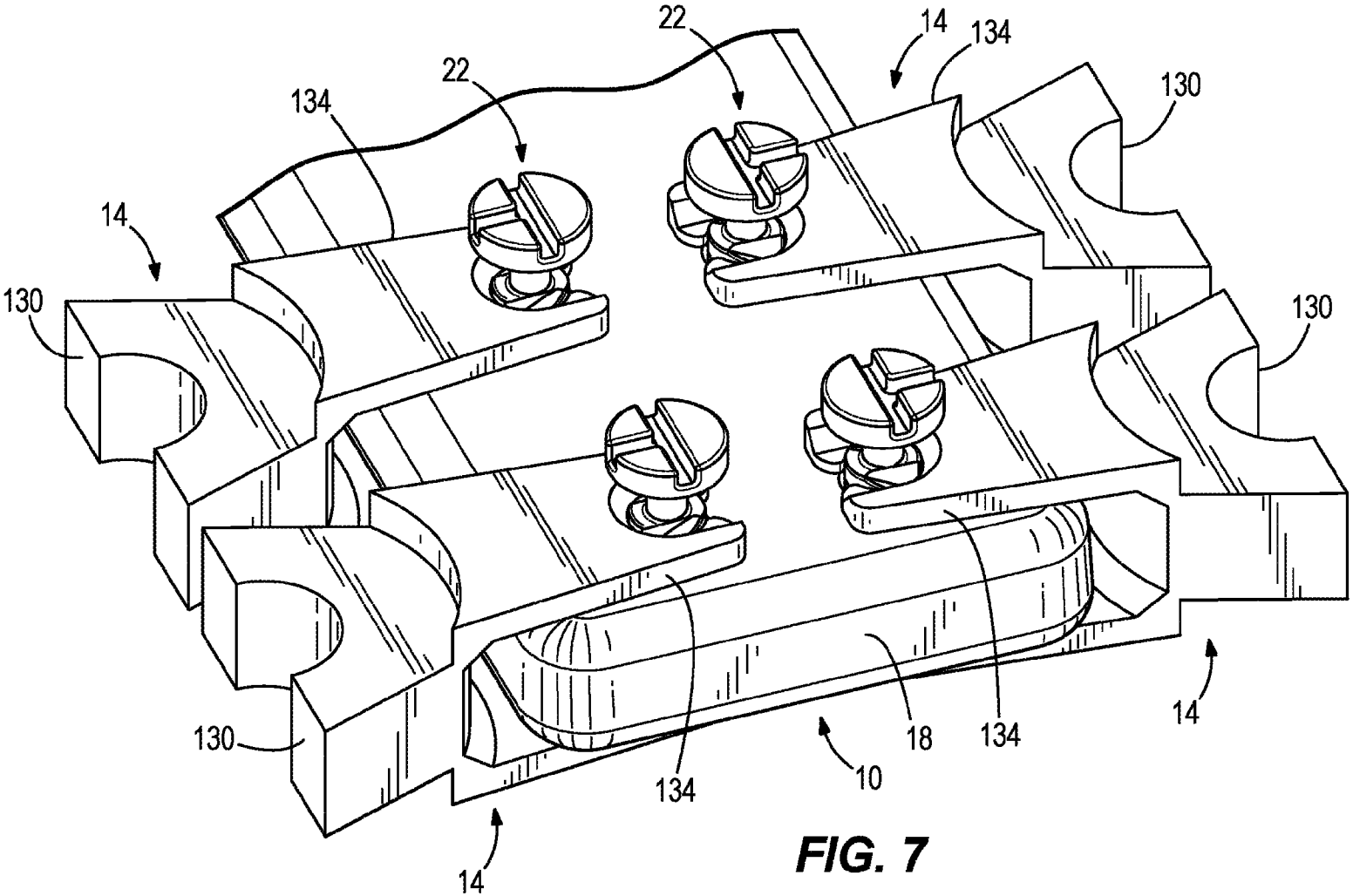
FIG. 7 is a perspective view of the die holder of FIG. 1, shown with pairs of differently sized crimping dies attached thereto.

With reference to FIGS. 6 and 7, the die holder 10 is intended to hold and organize crimping dies 14. Each of the dies 14 includes a crimping portion 130 and a mounting portion 134. The mounting portion 134 includes a pair of legs 138 that are spaced apart by a distance at least as wide as a width defined by the top and bottom sides 34, 38 of the holder body 18. Each of the legs 138 has a pin receiving opening 142 bounded by inward snap projections 146. The inward snap projections 146 define a gap 150 that extends into the pin receiving opening 142 from a distal end 154 of the mounting portion 134. The pin receiving opening 142 has a diameter 144 that is nominally greater than the second outer dimension 88 of the large diameter portion 86 of the die holding pin 22. The gap 150 has a width 152 that is greater than the first outer dimension 84 of the small diameter portion 82, but less than the second outer dimension 88 of the large diameter portion 86.

In the illustrated embodiment, the crimping dies 14 are "X" type dies. Other types of dies (e.g., "W" type dies) may also be supported by the die holder 10. The crimping dies 14 shown in FIGS. 6-9 are merely illustrative of one type of die that may be supported by the die holder 10.

During assembly of the die holder 10, the compression spring 106 is inserted into each of the die holding pin bores 26 followed by the die holding pin 22. The compression spring 106 is compressed between the large diameter portion 86 of the die holding pin 22 and the spring seating surface 62. The die holding pin 22 is then rotated within the die holding pin bore 26 until the first groove 94 defined in the head 78 is aligned parallel with the longitudinal axis A of the holder body 18 and the second groove 98 is directed at and aligned perpendicular with the nearest longitudinal side 42 of the holder body 18. Accordingly, the die holding pin 22 is oriented such that the elongated slot 90 is aligned with the retaining pin bore 66 and the inclined surfaces 114 of the die holding pin 22 face away from the longitudinal axis A of the die holder 10 (i.e., toward the longitudinal side 42 nearest the die holding pin 22). Once properly oriented, a retaining pin 68 is inserted through the retaining pin bore 66 and the elongated slot 90 of the die holding pin 22 to retain the die holding pin 22 within the die holding pin bore 26. The retaining pin 68 may be interference fit within the retaining pin bore 66 to prevent the retaining pin 68 from falling out of the retaining pin bore 66.

In order to attach the crimping die 14 to one of the die holding pins 22 of the holder 10, one simply slides the die 14 laterally onto the holder body 18, such that each of the mounting portions 134 of the die 14 slides adjacent and parallel to a corresponding one of the top and bottom sides 34, 38 of the holder body 18. The die 14 is then slid into a position, in which the narrow portion 126 of the die holding pin 22 is received in the gap 150 between the inward snap projections 146, such that each of the inward snap projections 146 contact the lower end 118 of one of inclined surfaces 114. The die 14 is then moved laterally along the top and bottom sides 34, 38 of the holder body 18 toward the longitudinal axis A of the holder body 18, causing the inward snap projections 146 to slide along the inclined surfaces 114, which then urges the die holding pin 22 to move toward the depressed position (FIG. 4) against the bias of the compression spring 106. Once the inward snap projections 146 pass the upper ends 122 of the inclined surfaces 114, the die holding pin 22 is returned to the biased position (FIG. 3) by the compression spring 106, such that the large diameter portion 86 is received within the pin receiving opening 142 of the die 14 (FIG. 7) to retain the die 14 relative to the holder body 18. The die 14 is retained on the die holder 10 by the inward snap projections 146, as the large diameter portion 86 is unable to pass through the gap 150.

Figure 8:
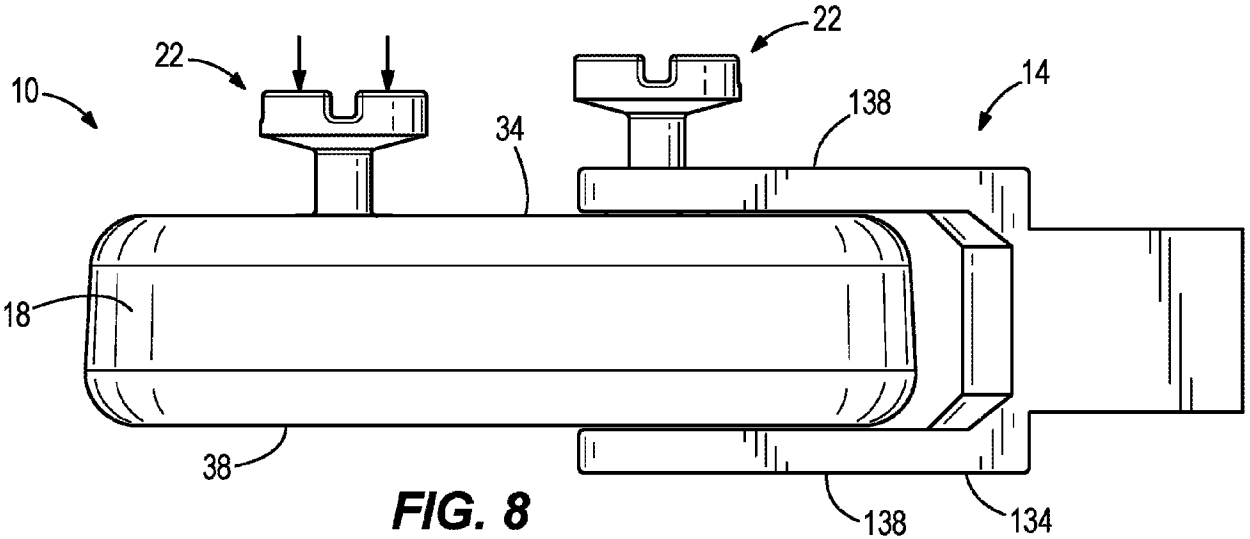
FIG. 8 is an end view of the die holder of FIG. 1, shown with a die holding pin in the second, depressed position.

To remove the die 14 from the die holder 10, the die holding pin 22 is simply manually depressed into the depressed position (FIGS. 4 and 8). Once the die holding pin 22 is in the depressed position, the die 14 may be slid laterally off the holder body 18 such that each of the mounting portions 134 of the die 14 slide adjacent and parallel to a corresponding one of the top and bottom sides 34, 38, passing the small diameter portion 82 of the die holding pin 22 through the gap 150.

Figure 9:
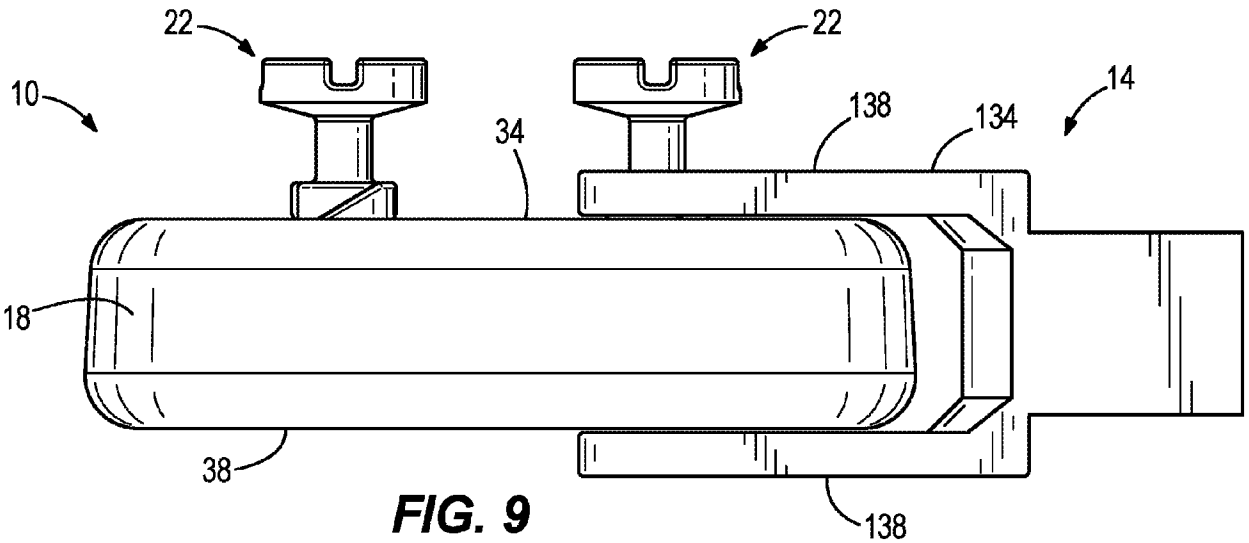
FIG. 9 is an end view of the die holder of FIG. 1, shown with a die holding pin in the first, biased position.

Alternatively, the die holding pin 22 may be manually moved to the depressed position (FIGS. 4 and 8). While depressed, the die 14 may be laterally slid onto the holder body 18, such that the small diameter portion 82 passes through the gap 150 and is received by the pin receiving opening 142. The die holding pin 22 may then be released, allowing the compression spring 106 to bias the die holding pin 22 to return to the biased position, such that the large diameter portion 86 is received within the pin receiving opening 142 of the die 14 (FIGS. 3 and 9). Due to the second outer dimension 88 of the large diameter portion 86 being larger than the gap 150, the die 14 is retained on the holder by the inward snap projections 146. The die 14 may be removed from the die holder 10 in a similar manner as described above.

Various features of the invention are set forth in the following claims.

What is claimed is:

1. A die holder for organizing and storing at least one die for use with a crimping tool, the die holder comprising:

a body including a first surface and a second surface parallel to and spaced from the first surface, and a first bore extending from the first surface toward the second surface, the first bore terminating at a location that is spaced from the second surface;

a die holding pin at least partially received within the first bore, the die holding pin having a first portion with a first outer dimension and a second portion with a second outer dimension greater than the first outer dimension, the die holding pin movable between a die retaining position and a die releasing position; and a spring configured to bias the die holding pin from the die releasing position toward the die retaining position, and wherein the die holding pin includes a first notch in the second portion defining a first inclined surface relative to a longitudinal axis of the die holding pin.

2. The die holder of claim 1, wherein the spring is a compression spring received within the first bore; and wherein the body includes a second bore extending from a third surface of the body adjacent the first and second surfaces, wherein the second bore intersects the first bore, wherein the die holding pin includes an elongated slot extending through the second portion and at least partially aligned with the second bore, and wherein the die holder further comprises a retaining pin extending through the second bore and the elongated slot.

3. The die holder of claim 1, wherein the first bore terminates at a spring seating surface on which the spring is seated.

4. The die holder of claim 3, wherein the body includes a boss within the first bore extending from the spring seating surface.

5. The die holder of claim 4, wherein an alignment bore is defined in the boss.

6. The die holder of claim 5, wherein the alignment bore is concentric with the first bore.

7. The die holder of claim 5, wherein the die holding pin includes an alignment pin at least partially received within the alignment bore.

8. The die holder of claim 1, wherein the die holding pin includes a second notch in the second portion defining a second inclined surface relative to the longitudinal axis, and wherein the first and second inclined surfaces are arranged on opposite sides of the longitudinal axis.

9. The die holder of claim 8, wherein a narrow portion is defined on the second portion of the die holding pin between the first and second notches, the narrow portion having a third dimension that is nominally equal to the first outer dimension.

10. The die holder of claim 1, wherein the die holding pin includes a head defining a first groove and a second groove that is perpendicular to the first groove.

11. A die holder assembly comprising:

a die holder including a body having a first surface and a second surface parallel to and spaced from the first surface, and a first bore extending from the first surface toward the second surface, the first bore terminating at a location spaced from the second surface;

a die holding pin at least partially received within the first bore, the die holding pin having a first portion with a first outer dimension and a second portion with a second outer dimension greater than the first outer dimension, the die holding pin movable between a die retaining position and a die releasing position;

a spring configured to bias the die holding pin from the die releasing position toward the die retaining position, and wherein the die holding pin includes a first notch in the second portion defining a first inclined surface relative to a longitudinal axis of the die holding pin; and at least one die for use with a crimping tool, the die having a mounting portion defining an opening in which the second portion of the die holding pin is received when the die holding pin is in the die retaining position, the mounting portion further defining a gap adjacent the opening through which the first portion of the die holding pin is movable when the die holding pin is in the die releasing position and the die holder is moved relative to the die in a direction parallel to the first and second surfaces.

12. The die holder assembly of claim 11, wherein the spring is a compression spring received within the first bore; and wherein the body includes a second bore extending from a third surface of the body adjacent the first and second surfaces, wherein the second bore intersects the first bore, wherein the die holding pin includes an elongated slot extending through the second portion and at least partially aligned with the second bore, and wherein the die holder further comprises a retaining pin extending through the second bore and the elongated slot.

13. The die holder assembly of claim 11, wherein the first bore terminates at a spring seating surface on which the spring is seated.

14. The die holder assembly of claim 13, wherein the body includes a boss within the first bore extending from the spring seating surface, wherein the boss defines an alignment bore therein, and wherein the die holding pin includes an alignment pin at least partially received within the alignment bore.

15. The die holder assembly of claim 11, wherein the die holding pin includes a second notch in the second portion defining a second inclined surface relative to the longitudinal axis, wherein the first and second inclined surfaces are arranged on opposite sides of the longitudinal axis.

16. The die holder assembly of claim 15, wherein a narrow portion is defined on the second portion of the die holding pin between the first and second notches, the narrow portion having a third dimension that is nominally equal to the first outer dimension.

17. The die holder assembly of claim 16, wherein the mounting portion includes a first leg and a second leg cooperating to define the opening.

18. The die holder assembly of claim 17, wherein the first and second legs include, respectively, first and second inward projections extending towards each other and cooperating to define the gap.

19. The die holder assembly of claim 18, wherein the first and second inclined surfaces each include a lower end and an upper end, and wherein when the die holding pin is in the die retaining position and the die is moved in a direction parallel to the first and second surfaces and towards the die holding pin, the first inward projection slides along the first inclined surface from the lower end to the upper end and the second inward projection slides along the second inclined surface from the lower end to the upper end, displacing the die holding pin from the die retaining position towards the die releasing position against the bias of the compression spring.

20. A die holder for organizing and storing at least one die for use with a crimping tool, the die holder comprising:

a body including a first surface and a second surface parallel to and spaced from the first surface, and a first bore extending from the first surface toward the second surface, the first bore terminating at a location that is spaced from the second surface;

a die holding pin at least partially received within the first bore, the die holding pin having a first portion with a first outer dimension and a second portion with a second outer dimension greater than the first outer dimension, the die holding pin movable between a die retaining position and a die releasing position; and a spring configured to bias the die holding pin from the die releasing position toward the die retaining position, wherein the spring is a compression spring received within the first bore, and wherein the body includes a second bore extending from a third surface of the body adjacent the first and second surfaces, wherein the second bore intersects the first bore, wherein the die holding pin includes an elongated slot extending through the second portion and at least partially aligned with the second bore, and wherein the die holder further comprises a retaining pin extending through the second bore and the elongated slot.

21. A die holder for organizing and storing at least one die for use with a crimping tool, the die holder comprising:

a body including a first surface and a second surface parallel to and spaced from the first surface, and a first bore extending from the first surface toward the second surface, the first bore terminating at a location that is spaced from the second surface;

a die holding pin at least partially received within the first bore, the die holding pin having a first portion with a first outer dimension and a second portion with a second outer dimension greater than the first outer dimension, the die holding pin movable between a die retaining position and a die releasing position; and a spring configured to bias the die holding pin from the die releasing position toward the die retaining position, and wherein the die holding pin includes a head defining a first groove and a second groove that is perpendicular to the first groove.

22. A die holder assembly comprising:

a die holder including a body having a first surface and a second surface parallel to and spaced from the first surface, and a first bore extending from the first surface toward the second surface, the first bore terminating at a location spaced from the second surface;

a die holding pin at least partially received within the first bore, the die holding pin having a first portion with a first outer dimension and a second portion with a second outer dimension greater than the first outer dimension, the die holding pin movable between a die retaining position and a die releasing position; and a spring configured to bias the die holding pin from the die releasing position toward the die retaining position; and at least one die for use with a crimping tool, the die having a mounting portion defining an opening in which the second portion of the die holding pin is received when the die holding pin is in the die retaining position, the mounting portion further defining a gap adjacent the opening through which the first portion of the die holding pin is movable when the die holding pin is in the die releasing position and the die holder is moved relative to the die in a direction parallel to the first and second surfaces, and wherein the spring is a compression spring received within the first bore, and wherein the body includes a second bore extending from a third surface of the body adjacent the first and second surfaces, wherein the second bore intersects the first bore, wherein the die holding pin includes an elongated slot extending through the second portion and at least partially aligned with the second bore, and wherein the die holder further comprises a retaining pin extending through the second bore and the elongated slot.

* * * * *